United States Patent [19]

Virtue et al.

[11] 3,985,472

[45] Oct. 12, 1976

[54] COMBINED FIXED AND VARIABLE DISPLACEMENT PUMP SYSTEM

[75] Inventors: Eugene P. Virtue, Tinley Park; Richard J. Lech, Lockport, both of Ill.

[73] Assignee: International Harvester Company, Chicago, Ill.

[22] Filed: Apr. 23, 1975

[21] Appl. No.: 570,970

[52] U.S. Cl. ..... 417/216; 417/286; 417/287; 417/426; 60/428

[51] Int. Cl.[2] ..... F04B 49/00; F04B 23/04

[58] Field of Search ..... 60/428, 430; 417/216, 417/286, 287, 426

[56] References Cited

UNITED STATES PATENTS

| | | | |
|---|---|---|---|
| 2,546,034 | 3/1951 | Lansing | 417/216 |
| 3,060,858 | 10/1962 | Shoosmith | 417/216 |
| 3,526,468 | 9/1970 | Moon et al. | 417/216 |
| 3,695,783 | 10/1972 | Soyland et al. | 417/216 |
| 3,723,026 | 3/1973 | Soyland et al. | 417/216 |
| 3,732,036 | 5/1973 | Busbey et al. | 417/216 |
| 3,841,795 | 10/1974 | Ferre et al. | 417/216 |

*Primary Examiner*—William L. Freeh
*Assistant Examiner*—G. P. LaPointe
*Attorney, Agent, or Firm*—Douglas W. Rudy; Floyd B. Harman

[57] ABSTRACT

A hydraulic pump arrangement and control circuit for supplying fluid at high volume and a high pressure to a work circuit. The system utilizes a fixed displacement pump, a variable displacement pump, a dual pressure compensator, and an unloading valve working together to provide high pressure fluid delivery while reducing the horsepower requirements of the fixed displacement pump and the variable displacement pump. High flow is provided through the utilization of the combined pumps and high pressure is attained through the unloading of the fixed displacement pump through the unloading valve and destroking of the variable displacement pump in response to signals provided by the dual pressure compensator.

6 Claims, 4 Drawing Figures

20
18
38
36
14
PV
16
12
PF
10
E
COMP
58
40
22
60
24
68
50
54
62
64
42
80
122
120
70
66
56
18
44
34
32
46
18
48
26
28
WORK CIRCUIT
30

COMBINED FIXED AND VARIABLE DISPLACEMENT PUMP SYSTEM

BACKGROUND OF THE INVENTION

1. Field of the Invention:

The invention relates to fluid control systems having a fixed displacement pump and a variable displacement pump working in unison and controlled by a regulating circuit normally for use on construction loaders, tractors, or other mobile implement carrying equipment.

2. Description of the Prior Art:

It is known to mount two fixed displacement pumps in tandem in a hydraulic circuit and control the output of these pumps through the use of various valving arrangements.

However, the use of a fixed displacement pump system of one or more than one pump becomes uneconomical in an application that requires high pressure but negligible fluid flow for any period of time as the fixed displacement pump will continue to attempt to deliver full flow even when only minimal flow is needed. This waste of pump capacity draws horsepower from the prime mover supplying the pump and if continued will eventually stall the prime mover. In cases where the work circuit has a relief valve the relief valve will allow the dumping of fluid as it is being pumped by the fixed displacement pump thus generating undesirable heat in the fluid of the work circuit. Multiple fixed displacement pump systems are designed to reduce this wasteful pump operation by having different displacement pumps that can be called upon in various operating or load situations to deliver the required fluid volume or pressure. Unfortunately multiple fixed displacement pump systems still have the high pressure deficiencies previously mentioned.

It is also known to use a variable displacement pump to satisfy the needs of a hydraulic fluid control system. It is not usual, however, to find two or more variable displacement pumps in tandem as is found with fixed displacement pumps as the variable displacement pump supplies fluid at the pressure and the volume needed by the hydraulic system to which it is responsive.

The primary drawback of a variable displacement pump is the cost of the pump. An investigation of available hydraulic pumps and their respective costs will indicate advantages other than efficiency. The least expensive pumps presently used in hydraulic systems are gear type fixed displacement pumps. These pumps have limited pressure potential but are available in a wide variety of displacements. Variable volume piston pumps are comparatively expensive (especially in larger displacement sizes) and have limited availability in different displacements. Also a drawback is that there may be a slight lag in the stroking or destroking operation of the variable displacement piston pump.

A fixed displacement pump will generate relatively instant pressure and flow to a work circuit when the circuit valving is opened due to the positive displacement characteristic of the fixed displacement pump. The combination system proposed in this invention utilizes the best characteristics of each type pump. The variable displacement piston pump is used alone for high pressure requirements while a combination of the variable displacement piston pump and the fixed displacement gear pump will meet the high flow demands of the system. Therefore, the combination of a fixed and variable displacement pump in a regulated system such as the dual pressure compensator controlled system of this invention will have the advantage of the instant acting fluid delivery inherent in the fixed displacement pump and the high pressure, low horsepower consuming characteristics available with a variable displacement pump. A combination pump system therefore maximizes performance, efficiency, and dependability while minimizing costs.

Therefore it is an object of the invention to provide a hydraulic pump system that provides high pressure and high flow when needed and yet does not waste pump driving horsepower when only high pressure and low flow is needed.

Further it is object of the invention to provide a pump system that will not "bog down" the vehicle engine when high pressure work loads are imposed on the system. Another object is to provide a pump system that can provide pressure to a work circuit immediately upon request. A further object of the invention is to provide a compensator which is responsive to a dual pressure input to signal stroking or destroking of a variable displacement pump. A further object of the invention is to provide a hydraulic pump system that can maintain high work circuit pressure at a low horsepower requirement. Another object of the invention is to provide a hydraulic circuit that doesn't cause excessive heat generation in the fluid thereof. Also an object of the invention is to provide a combination pump system that delivers good performance at a reasonably moderate cost.

SUMMARY OF THE INVENTION

A multiple pressure hydraulic fluid system for use on agricultural or industrial equipment that is designed to deliver fluid flow at high volume or fluid at high pressure depending on the needs of circuit involved.

A dual pump arrangement having a fixed displacement pump and a variable displacement pump is so controlled by a dual pressure compensator receiving a signal from a control line communicating with each of the output ports of the aforementioned pumps and an unloading valve which has the ability to dump the output of the fixed displacement pump such that the desired results mentioned above are made possible.

More specifically this is accomplished through the use of a fluid circuit regulated by a dual pressure compensating system which has the following significant components.

A variable displacement normally piston type pump which is driven by a prime mover has an inlet port communicating with the source of fluid such as a reservoir and an outlet port providing fluid delivery from the variable displacement pump. A fixed displacement pump which is driven by the same prime mover has an inlet communicating with a source of fluid such as a reservoir and an outlet port providing fluid under pressure to a work circuit. The variable displacement pump mentioned above has a pressure responsive actuator common to variable displacement piston type pumps. The output of both the variable displacement pump and the fixed displacement pump communicate with an incremental pressure compensating device which is initially responsive to the combined fluid output pressure of both pumps and secondarily reponsive to the fluid output pressure of the variable displacement pump alone. This compensating device will signal the pressure responsive actuator of the variable displacement pump to either stroke or destroke as necessary to accommodate the requirements of the work system. Also an integral part of the system is a pressure responsive unloading valve which is responsive to the combined fluid output pressure of the fixed displacement pump and the variable displacement pump which when activated will divert output from the fixed displacement pump to a reservoir. There is a check valve in the conduit communicating with both the fixed and variable displacement pumps that prevents output from the variable displacement pump from being passed in a reverse direction through the fixed displacement pump and thence to the reservoir.

BRIEF DESCRIPTION OF THE DRAWINGS

Other objects and advantages of the invention will become apparent upon reading the following detailed description and upon reference to the drawings in which.

DETAILED DESCRIPTION OF THE INVENTION

Figure 1:
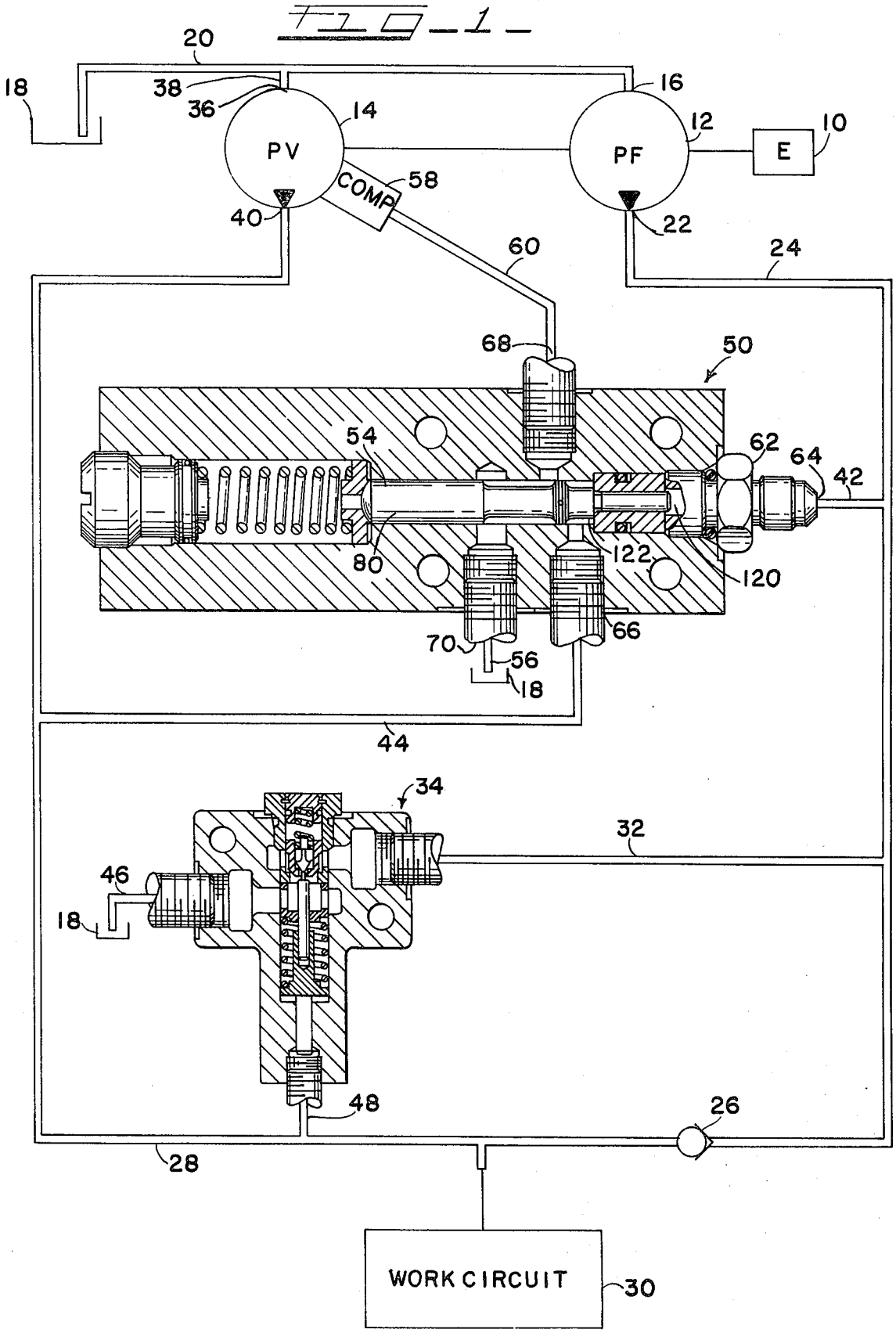
FIG. 1 is a schematic diagram of the dual pump system of the invention with several components shown in partial section.
Figure 2:
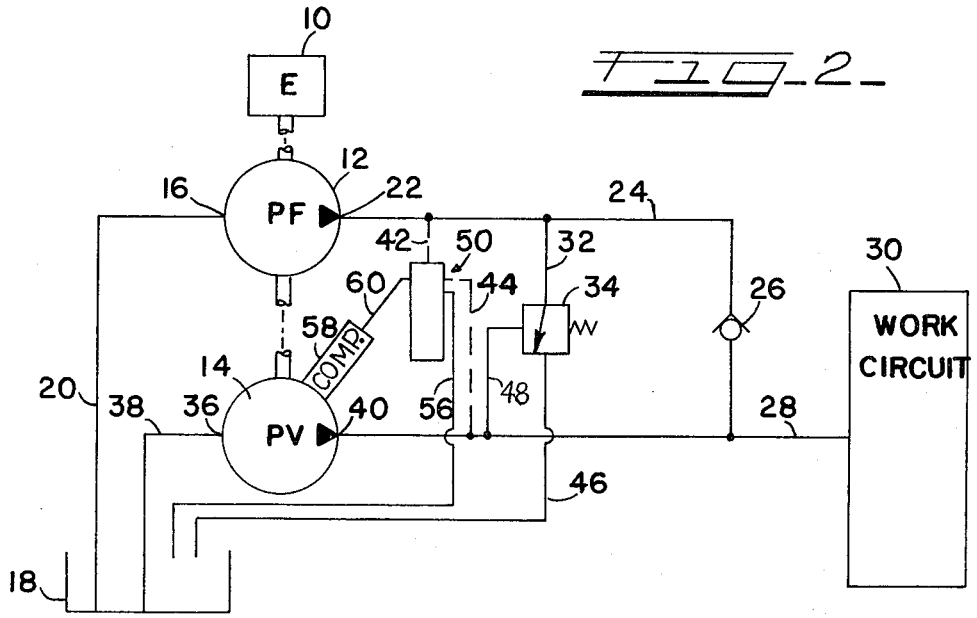
FIG. 2 is a schematic diagram of the combined pump system of the invention.

Referring now to FIGS. 1 and 2 of the drawings the invention and its application is shown by the schematic presentations wherein a prime mover 10 is provided to communicate a driving force to the fixed displacement pump 12 of the positive displacement gear type, generally but not exclusively, and a variable displacement pump 14 generally of the axial piston type positive displacement pump. Hereinafter, the fixed displacement pump will be referred to as the PF and the variable displacement pump will be referred to as the PV. These being generally recognized abreviations for each of these respective pumps. The PF 12 has an inlet 16 communicating with fluid reservoir 18 by means of conduit 20. The output or outlet port 22 of the PF 12 is connected to conduit means 24 and the fluid pumped by the PF 12 normally passes through a one way check valve 26 before joining the output of the PV 14 and conduit means 28 which connects the pump system with the work circuit 30. An alternative pass for the fluid output of the PF 12 is possible through conduit means 32 which intercepts conduit means 24. Conduit means 32 progresses from conduit means 24 through an unloading valve 34 of the pilot operated type thence to fluid reservoir 18 through conduit means 46. Fluid will pass from the outlet port 22 of the PF 12 to the fluid reservoir 18 upon activation of unloading valve 34 which is responsive to a pressure signal from conduit 48 by means of conduit 28. This unloading valve shown as 34 in FIG. 1 is of the pilot operated type having a progressive opening means, however, this valve could be of a more conventional type if desired.

The variable displacement pump or PV 14 has an inlet port 36 communicating with the fluid reservoir 18 by means of conduit 38. The PV 14 is driven by a prime mover 10 represented as driving both the PF 12 and the PV 14. However, this is only a schematic representation and alternative methods of pump driving would be to use two prime movers or other reasonable alternatives. Conduit means 28 connects the outlet port 40 of the PV 14 with the work circuit 30. The PV, being of the axial piston positive displacement type pump having a swash plate and a hydraulic actuator, is not shown in detail as pumps of this type are well knwon in the art.

A dual pressure compensator generally depicted as 50 is shown schematically in operative communication with the PV 14. Conduit means 42, generally a pilot or signal line, provides fluid communication between the conduit means 24 of the PF outlet port 22 and the dual pressure compensator 50. A second conduit means 44 provides fluid communication between the dual pressure compensator 50 and the conduit means 28 connecting the outlet port 40 of the PV 14 to the work circuit 30. This conduit means 44 is also a pilot or signal type line.

The work circuit generally depicted as 30, is not specified in detail but could be, for example, the hydraulic system of a construction duty tractor having a backhoe and a forward carried bucket scoop. This system would have operating cylinders for moving the work implements through a wide range of digging, delivering, transferring and holding postures. Also, the work circuit may include hydrostatic or hydraulic transmission means, direction control means and additionally any other unspecified fluid operated apparatus as can be imagined.

Figure 3:
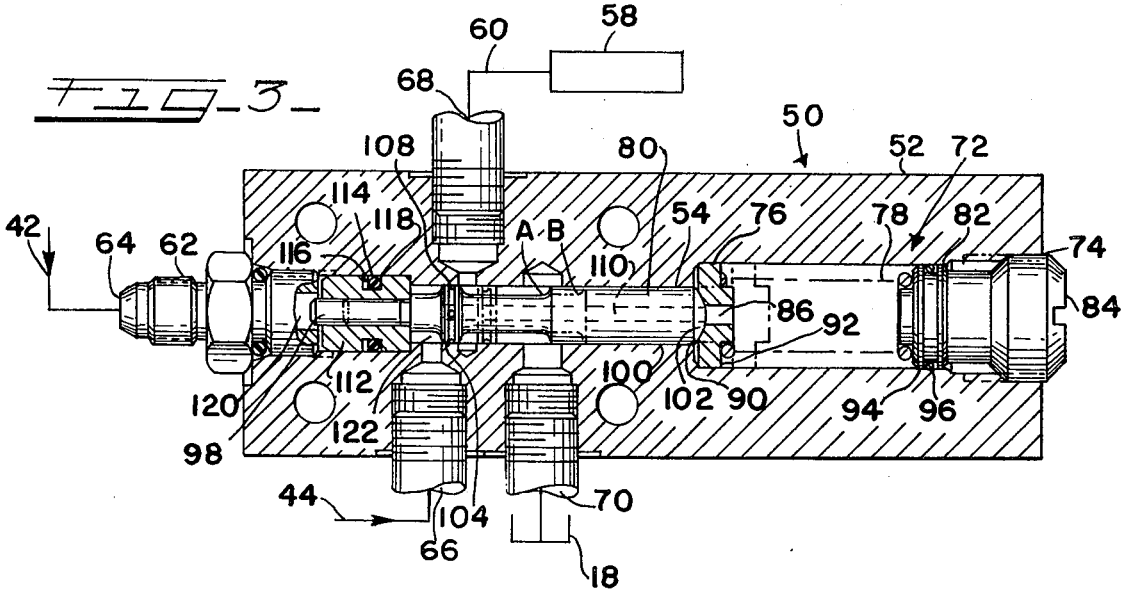
FIG. 3 is a sectioned view of the dual pressure compensator.

Turning now to FIG. 3 a detailed description of the dual pressure compensator, generally depected as 50, will be given.

The dual pressure compensator housing 52 has been provided with a bore 54 therethrough having several concentric diameters.

The first end 62 of the bore 54 acts as a first inlet port 64 of the dual pressure compensator 50. The housing is also equipped with a second inlet port 66, a first outlet port 68, and a second outlet port 70 which all communicate independently with the bore 54.

As shown by the schematic presentation of FIG. 1 first inlet port 64 communicates through conduit means 42 and 24 to the outlet port 22 of the the PF 12. Second inlet port 66 communicates with outlet port 40 of the PV 14 through conduit means 44 and 28. First outlet port 68 communicates with the destroking actuator 58 by means of conduit 60. Second outlet port 70 communicates with the bore 54 and the fluid reservoir 18 by means of conduit 56.

Looking again at FIG. 3 wherein slidably carried inside bore 54 is a spool 80 held in its normal position by a biasing assembly 72 carried in the larger second end 74 of bore 54. The biasing assembly 72 has a pressure plate 76 locating a biasing means represented by coil spring 78 which is further guided by a retainer plate 82. A retainer plate adjustment screw 84 is threadably mounted in the second end 74 of bore 54 such that adjustment of the retainer plate adjustment screw 84 will result in varying the pressure exerted on the spool 80 by the biasing apparatus 72.

The pressure plate 76 is further distinguished by having an aperture 86 formed therein coincidental to the minor axis of the plate 76. Also formed on the innermost surface of the pressure plate 76 is an arcuate concave spool receiver 90 and the outermost surface of pressure plate 76 is contact surface 92 for aligning and guiding the coil spring 78.

The retainer plate 82 is equipped with a groove 94 for holding an O-ring 96 against the walls of the bore 54 and minimizing leakage of fluid which will be present in this section of bore 54.

Still considering FIG. 3 it is noted that spool 80 has a first end 98 of somewhat smaller diameter than the second end 100. Further the second end 100 has an arcuate portion which is compatible with the concave spool receiver 90 mentioned above.

A land 104 is formed on the spool 80 dividing the midsection of the spool, which has a diameter greater than the diameter of the first end 98 of the spool and less than the second end 100 of the spool, into two portions. The land 104 has a groove 108 circumferentially formed on it. This groove 108 provides a galley or channel for directing fluid to an internal passage 110 running through the spool 80 from the land 104 to the arcuate portion 102 thereof.

Spool alignment is further ensured through the use of spool alignment collar 112 encompassing first end 98 of the spool 80. The alignment collar 112 carries an O-ring 114 and a washer 116 in a circumferential groove 118 formed in the alignment collar 112.

Two chambers are formed in the bore 54 by the surrounding components. These are shown as first chamber 120 at the first end 62 of the bore 54 and second chamber 122 formed between land 104 and the alignment collar 112. Regardless of spool position the first chamber 120 can only communicate with first inlet port 64. Second chamber 122 communicates with the second inlet port 66 until the spool 80 is shifted against the biasing assembly 72 sufficiently far to enable communication between the second inlet port 66 and the first outlet port 68. First outlet port 68 can communicate with second outlet port 70 when spool land 104 is shifted fully to the left as depicted by solid line position A.

The normal operation of the combined fixed and variable displacement pump system with the dual pressure compensator just described will be explained in conjunction with FIG. 4 when considered with the explanations of FIGS. 1, 2 and 3 previously presented.

When there is no load presented to the combined pump fluid delivery system from the work circuit 30 both pumps 12 and 14 would be providing fluid to the work circuit which would direct this fluid to the reservoir as no work would be required. This situation is represented by point A on the graph which communicates that there is little horsepower being used to generate just enough pressure to ensure fluid flow.

Note that the Horsepower scale does not indicate raw horsepower being used by the prime mover, which may also be driving a host vehicle, but rather net horsepower to drive the dual pump system and provide pressure in the fluid system under consideration.

The fixed displacement pump, PF 12, is at full flow delivery as is the variable displacement pump PV 14. The unloading valve is in a closed mode as represented in FIG. 3 as solid line position A. The spool 80 of the dual pressure compensator 50 is biased as far as possible toward the first end 62 of the bore 54 preventing fluid flow between the second inlet port 66 and the first outlet port 68. The check valve 26 is allowing passage of fluid through conduit means 24.

Upon system demand requiring ever increasing pressure the following cycle will be encountered.

Figure 4:
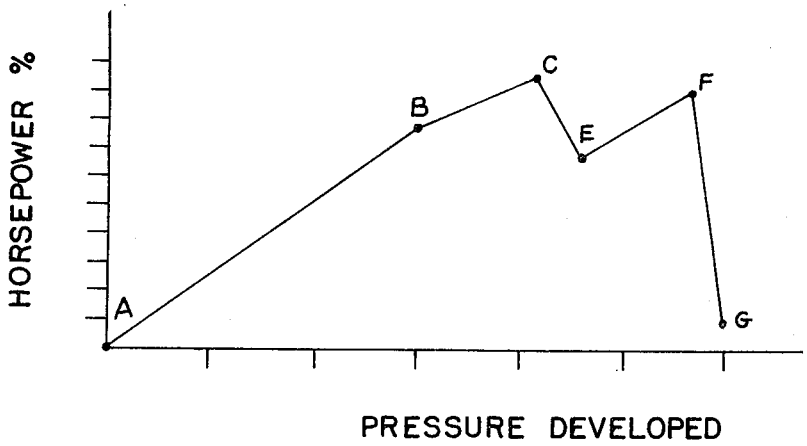
FIG. 4 is a graph showing the relationship between horsepower requirements and pressure generated by the combined pump system.

Increasing pressure, resultant of work circuit load, is represented on FIG. 4 as line A–B. Both pumps are working together and as pressure needed to operate the work circuit increases the horsepower to drive the pumps increases. The situation will progress until point B when the fixed displacement gear pump will be at full pressure capacity. At point B the variable displacement pump is signaled to commence destroking. The term destroking is used in the vernacular to define the change in a piston type variable displacement pump when it goes from full stroke to partial stroke. In other words, the displacement of the pump decreases in terms of fluid output, however, it increases in terms of pressure generation. This is accomplished through the mechanisms of the dual pressure compensator.

Pressure in the first chamber 120 has increased with the pressure generated by the PF pump. This pressure increase was communicated between conduit means 24 and the dual pressure compensator 50 by conduit means 42 (see FIG. 1). A portion of the first chamber' s boundry is the first end 98 of the spool 80. Thus, spool 80 is biased against the biasing assembly 72 by any significant pressure in the first chamber 120.

Pressure in the second chamber 122 has also been increasing. The second chamber 122 gets a fluid pressure signal from conduit means 28 through conduit means 44.

To reiterate, point B represents the pressure at which the pressure in the first chamber 120 and point in the second chamber 122 have combined to override the pressure on spool 80 imposed by biasing assembly 72. This forces the piston land 104 to slide past the first outlet port 68. This action then allows passage of fluid from the second inlet port 66 to the first outlet port 68 which communicates with the actuator 58 of the PV 14. The actuator of the PV will destroke the pump as necessary as system pressure continues to increase.

At point C the PV will have been at least partially destroked and at this point the PF 12 will be unloaded to reservoir 18 by means of unloading valve 34.

The pressure in conduit means 28 is communicated to the unloading valve 34 by means provided by conduit 48 which is a pilot line for the unloading valve. The unloading valve 34 is set to open at system pressure that would start to bog down the prime mover due to the positive displacement characteristics of both the fixed and variable displacement pumps. Since the PF 12 can no longer provide increasing pressure to the system it is effectively relieved of this task by the unloading valve 34.

When the unloading valve 34 is opened fluid will flow from the outlet port 22 of the PF 12 through the conduit means 24 then through conduit means 32, through valve 34, conduit 46, to the fluid reservoir 18. Check valve 26 will prevent fluid conduit means 28 from reversing through the unloading valve or the dual pressure compensator. This unloading of the fixed displacement pump or PF 12 will decrease the horsepower consumed by the PF and make available more horsepower to drive the variable displacement pump PV to higher pressure. Line C–E represents the drop in horsepower being utilized as a consequence of the PF going to dump.

The fixed displacement pump is now at full flow delivery to the reservoir. The variable displacement pump is at a stroked displacement providing pressure and flow as necessary. The unloading valve is opened allowing the output of the PF to pass to reservoir 18.

The PV has been allowed to stroke due to the drop in pressure at the first chamber 120 of the dual pressure compensator 50 resulting from the absence of pressure being delivered by the PF.

At point F of FIG. 4 the dual pressure compensator again starts to see high enough pressure to initiate further destroking of the PV. This is signalled by the pressure in the second chamber 122 getting high enough to force the spool 80 against the biasing assembly 72 far enough to have land 104 clear the first outlet port 68. The destroking of PV is accomplished at point F as earlier described.

At point G the PV is fully destroked. The PF is unloaded to reservoir and the check valve is closed. This point represents the maximum pressure available to the work circuit. The horsepower is low because the PF is going to the reservoir and imposing only minimal horsepower drain on the prime mover and the PV is fully destroked again which also imposes only marginal horsepower drain on the prime mover.

The benefit here is that the work circuit has not bogged down the prime mover even under full pressure. The work circuit, for instance the backhoe previously mentioned, would have its maximum digging force at this point yet the engine would be at a normal RPM level.

Upon release of system pressure requirements the pressure in pilot means 44 would drop off causing the pressure in the second chamber 122 to decrease allowing the spool 80 in the dual pressure compensator 50 to be urged back to a closed position by biasing assembly 72. This is shown by spool position A of FIG. 3.

When the spool 80 is back in the unloaded position passage between the first outlet port 68 and the second outlet port 70 is possible. This allows fluid to flow from the destroking actuator 58 of the PV to the fluid reservoir 18. The PV is of course fully stroked when this is done.

The system is now effectively back to point A of the graph in FIG. 4 and ready to begin the increasing pressure pump compensation cycle again. It should be pointed out that the cycle need not be followed to optimum pressure every time it is utilized. The system can be used incrementally as required by the demand put on the pumps by the work circuit load. In other words the frequency of the highest pressure delivery of the system will occur sporadically depending on the type of work being done by the work circuit.

Thus it is apparent that there has been provided in accordance with the invention a dual pressure compensator working with a fixed and variable displacement pump system that fully satisfies the objects, aims and advantages set forth above. While the invention has been described in conjunction with specific embodiments thereof it is evident that many alternative modifications and variations will be apparent to those skilled in the art in light of the foregoing description. Accordingly this invention is intended to embrace all such alternatives and modifications and variations as fall within the spirit and broad scope of the appended claims.

What is claimed is:

1. A fluid circuit comprising:

a work circuit having fluid actuated apparatus;

conduit means communicating with said work circuit;

a fixed displacement pump having an inlet port and an outlet port providing fluid delivery to said work circuit through said conduit means;

a variable displacement pump, having an inlet port and an outlet port and further having a destroking actuator providing fluid output to said work circuit through said conduit means;

a prime mover means for driving said fixed displacement pump and said variable displacement pump;

a dual pressure sensing compensator device having a housing with a cylindrical bore therethrough and a valve spool reciprocally mounted in the cylindrical bore providing a first chamber communicating with the output port of said fixed displacement pump, and a second chamber communicating through said conduit means with the outlet port of said variable displacement pump, and the housing further having a port allowing fluid communication between the variable displacement pump outlet port and the destroking actuator of said variable displacement pump through said conduit means;

an unloading valve responsive to pressure in said conduit means capable of directing the output flow from the fixed displacement pump to a reservoir; and a check valve in said conduit means preventing fluid flow from passing between the outlet side of said variable displacement pump and the outlet side of said fixed displacement pump.

2. The invention in accordance with claim 1 wherein said variable displacement pump is of the in-line axial positive displacement piston type.

3. The invention in accordance with claim 1 wherein said fixed displacement pump is a positive displacement gear type pump.

4. A fluid circuit capable of delivering fluid under high pressure regulated by a dual pressure compensating system comprising:

a variable displacement pump driven by a prime mover having an inlet port communicating with a source of fluid and an outlet port providing fluid under pressure;

a fixed displacement pump driven by a prime mover having an inlet communicating with a source of fluid and an outlet port providing fluid;

conduit means communicating the outlet port of said variable displacement pump and the outlet port of said fixed displacement pump to a work circuit;

a pressure responsive actuator for controlling the displacement of said variable displacement pump;

an incremental pressure compensating device in communication with and initially responsive to the combined fluid output pressure of said fixed displacement pump and said variable displacement pump, and secondarily responsive to the fluid output pressure of said variable displacement pump alone, communicating with said pressure responsive actuator whereby said pressure responsive actuator will generate a reduction in the displacement of said variable displacement pump;

A pressure responsive unloading valve means in communication with and responsive to the combined fluid output pressure of said fixed displacement pump and said variable displacement pump, said pressure responsive unloading valve means activated to divert output from the fixed displacement pump to a reservoir by pressure in said conduit means higher than the pressure which initially generated the reduction in the displacement of said variable displacement pump:

a check valve in said conduit means positioned to prohibit passage of fluid from a source other than the output of said fixed displacement pump through said pressure responsive unloading valve to a reservoir.

5. A method of providing high flow and increased pressure in a hydraulic fluid system while decreasing the horsepower requirements of said system which comprises:

pumping fluid through a circuit using a fixed displacement pump and a variable displacement pump simultaneously;

destroking said variable displacement pump using the combined pump pressure sensed by a dual pressure compensator which initiates destroking of the variable displacement pump;

dumping the output of the fixed displacement pump after the combined pump system reaches a preset value by means of an unloading valve;

stroking the variable displacement pump to replenish the fluid lost when the fixed displacement pump was unloaded to reservoir;

destroking said variable displacement pump responsive to the pressure in said fluid circuit as sensed by the dual pressure compensator.

6. In a fluid circuit comprising a fixed displacement pump, a variable displacement pump having a pressure responsive actuator, an unloading valve, a check valve, and a work circuit all communicatively assembled the improvement comprising:

a dual pressure compensator responsive to the combined pressure generated by said fixed and said variable displacement pumps such that at a first preset pressure the variable pump will commence to destroke and consequently generate higher pressure until the unloading valve is actuated at higher pressure to dump the output of said fixed displacement pump causing the stroking of said variable displacement pump until a third pressure level is reached at which time the dual pressure compensator, acting on the pressure generated by the variable displacement pump alone will signal the pressure responsive actuator of said variable displacement pump to commence destroking of said variable displacement pump.

* * * * *